US008032067B2

(12) United States Patent
Miyamoto et al.

(10) Patent No.: US 8,032,067 B2
(45) Date of Patent: Oct. 4, 2011

(54) CIRCULAR BODY, CIRCULAR BODY UNIT, AND IMAGE FORMING APPARATUS

(75) Inventors: Masahiko Miyamoto, Kanagawa (JP); Nobuyuki Ichizawa, Kanagawa (JP); Yousuke Tsutsumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 398 days.

(21) Appl. No.: 12/411,028

(22) Filed: Mar. 25, 2009

(65) Prior Publication Data

US 2009/0245895 A1 Oct. 1, 2009

(30) Foreign Application Priority Data

Mar. 26, 2008 (JP) ..... 2008-082020

(51) Int. Cl.
*G03G 15/08* (2006.01)
*G03G 15/01* (2006.01)
*G03G 15/20* (2006.01)

(52) U.S. Cl. ..... 399/302; 399/121; 399/308

(58) Field of Classification Search ..... 399/121, 399/302, 308
See application file for complete search history.

(56) References Cited

U.S. PATENT DOCUMENTS

| | | | | |
|---|---|---|---|---|
| 7,130,569 | B2 * | 10/2006 | Goodman et al. | 399/302 |
| 2009/0074480 | A1 * | 3/2009 | Suzuki | 399/308 |
| 2009/0238614 | A1 * | 9/2009 | Kakyo | 399/302 |

FOREIGN PATENT DOCUMENTS

| | | |
|---|---|---|
| JP | A-11-045010 | 2/1999 |
| JP | A-2005-091789 | 4/2005 |
| JP | A-2006-184547 | 7/2006 |

* cited by examiner

*Primary Examiner* — David Gray
*Assistant Examiner* — Joseph Wong
(74) *Attorney, Agent, or Firm* — Oliff & Berridge, PLC

(57) ABSTRACT

This invention provides a circular body, which is used for an image forming apparatus employing an electrophotographic system, the circular body containing: at least an inner layer containing resin and an outer layer that is laminated on an outer circumferential surface side of the inner layer and contains resin; and, as a conductive agent, polyaniline in the outer layer and carbon black in the inner layer; and satisfying the following relational expressions (1) and (2):

$$13.0 \leqq C1 \leqq 15.0 \quad (1)$$

$$21.5 \leqq C2 \leqq 25.0 \quad (2),$$

wherein C1 represents the content (parts by weight) of the polyaniline with respect to 100 parts by weight of the resin forming the outer layer, and C2 represents the content (parts by weight) of the carbon black with respect to 100 parts by weight of the resin forming the inner layer, as well as a circular body unit using the circular body and an image forming apparatus using the circular body.

17 Claims, 6 Drawing Sheets

CIRCULAR BODY, CIRCULAR BODY UNIT, AND IMAGE FORMING APPARATUS

CROSS-REFERENCE TO RELATED APPLICATION

This application is based on and claims priority under 35 USC 119 from Japanese Patent Application No. 2008-082020 filed Mar. 26, 2008.

BACKGROUND

1. Technical Field

The present invention relates to a circular body, a circular body unit, and an image forming apparatus.

2. Related Art

As an image forming device using an electrophotographic system, an image forming apparatus which forms an electrostatic latent image on an image support, such as an electrophotographic photoconductor, develops the electrostatic latent image with a toner, electrostatically transfers the obtained toner image to an intermediate transfer belt which is an endless belt (primary transfer process), and transfers the same again to a transfer-receiving medium such as transfer paper (secondary transfer process) to form an image, has been conventionally known. In particular, in an image forming device using a system (tandem system) for obtaining a fill color image by overlapping different colored toner images upon each other, an intermediate transfer belt has been preferably employed. In this kind of image forming apparatus, an electrically conductive intermediate transfer belt having electrical conductivity has been widely used.

In the intermediate transfer belt, electrical properties, such as surface resistivity and volume resistivity, are important in addition to mechanical strength, such as flexibility, bending resistance, and tensile breaking strength, in order to obtain an output image which is stable and favorable over a long period of time.

For example, an image forming apparatus has been proposed which uses a metal primary transfer roll and in which the surface resistivity (ρs) is controlled to $9 \leqq \rho s \leqq 12$ and the sum of the inner surface roughness of an intermediate transfer belt and the surface roughness of the primary transfer roll is adjusted to 1.2 μm or less.

Moreover, an example is disclosed in which, in a two-layer intermediate transfer belt, transferring properties are improved by adjusting the thickness of a belt upper layer to from 5 μm to 50 μm; adjusting the thickness of a lower layer (base layer) to from 50 μm to 200 μm; adjusting a ratio of the surface resistivity (ρs) of the upper layer to the surface resistivity (ρs) of the lower layer to 1000 or more; and adjusting the surface resistivity (ρs) of the upper layer to 13.0 Log Ω/□ or more.

Furthermore, an example is disclosed in which, in a two-layer intermediate transfer belt, toner scattering is suppressed by controlling the volume resistivity (ρv) of a belt upper layer to be higher than the volume resistivity (ρv) of a lower layer.

SUMMARY

According to an aspect of the invention, there is provided a circular body, which is used for an image forming apparatus employing an electrophotographic system, the circular body comprising:

at least an inner layer containing resin and an outer layer that is laminated on an outer circumferential surface side of the inner layer and contains resin; and as a conductive agent, polyaniline in the outer layer and carbon black in the inner layer, and satisfying relational expressions (1) and (2):

$$13.0 \leqq C1 \leqq 15.0 \quad (1)$$

$$21.5 \leqq C2 \leqq 25.0 \quad (2),$$

wherein C1 represents the content (part by weight) of polyaniline based on 100 parts by weight of resin forming the outer layer and C2 represents the content (part by weight) of carbon black based on 100 parts by weight of resin forming the inner layer.

BRIEF DESCRIPTION OF THE DRAWINGS

Exemplary embodiment(s) of the present invention will be described in detail based on the following figures, wherein.

DETAILED DESCRIPTION

Figure 1:
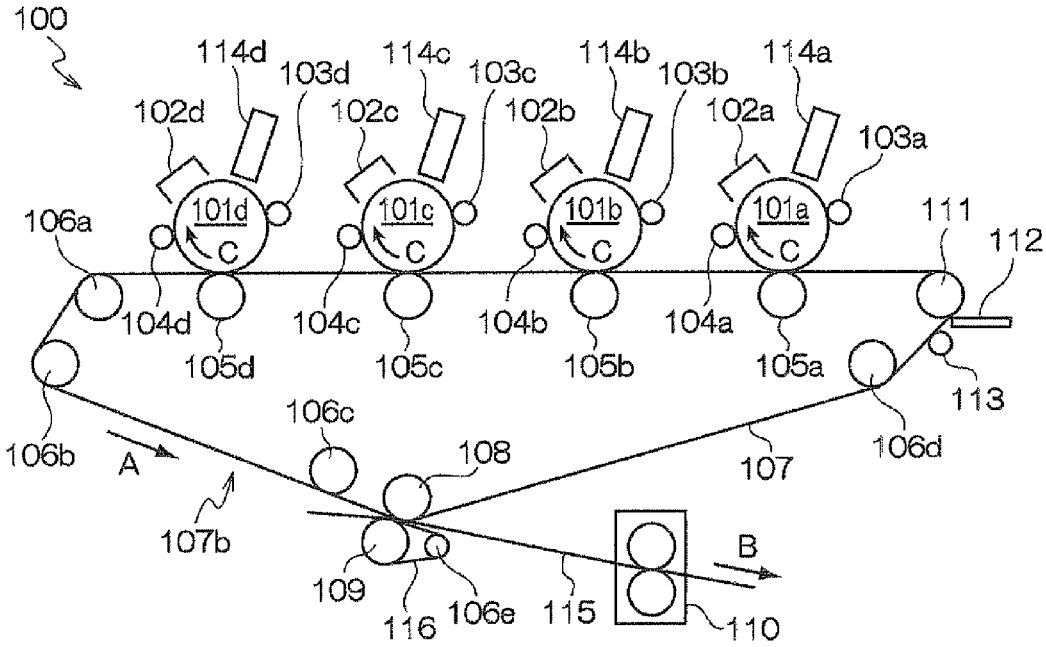
FIG. 1 is a view illustrating a preferable embodiment of an image forming apparatus of the present invention.

The present inventors found that the phenomenon that minute white spots generate is caused by electric charges flowing into the circular body from a primary transfer member touching the inner surface of the circular body in a primary transfer unit and a secondary transfer member touching the inner surface of the circular body in a secondary transfer unit. More specifically, in a case where the electric charges flowing into the circular body flows through the inside of the circular body to reach the outer peripheral surface, a discharge current path is formed from the inner surface to the outer surface of the circular body, increasing discharge current. The present inventors found that the increase in discharge current causes generation of minute white spots.

Moreover, the present inventors found that the minute white spots due to the increase in discharge current have become a remarkable problem as an applied voltage increases because a process rate is high, for example.

The present inventors found that the phenomenon that a scale like density unevenness occurs is caused by electrical discharge occurring between the secondary transfer member touching the inner surface of the circular body and the inner circumferential surface of the circular body in the secondary transfer unit. More specifically, the present inventors found that positive electric charges accumulate on the inner circumferential surface of the circular body due to electrical discharge, and flow inside the circular body to reach the surface, without spreading in the direction of the inner circumferential surface, whereby scale-like density unevenness corresponding to the charge distribution occurs.

The present invention provides a circular body providing a favorable output image in which the occurrence of image quality defects, such as minute white spots and scale-like density unevenness, on the output image is suppressed, a circular body unit using the circular body, and an image forming apparatus using the circular body.

Exemplary embodiments of the invention are described in detail hereinafter.

A first exemplary embodiment of the invention is a circular body, which is used for an image forming apparatus employing an electrophotographic system, the circular body including at least an inner layer containing resin and an outer layer that is laminated on an outer circumferential surface side of the inner layer and contains resin; and, as a conductive agent, polyaniline in the outer layer and carbon black in the inner layer, and satisfying the following relational expressions (1) and (2):

$$13.0 \leqq C1 \leqq 15.0 \quad (1)$$

$$21.5 \leqq C2 \leqq 25.0 \quad (2),$$

wherein C1 represents the content (part by weight) of polyaniline based on 100 parts by weight of resin forming the outer layer and C2 represents the content (part by weight) of carbon black based on 100 parts by weight of resin forming the inner layer.

A second exemplary embodiment of the invention is the circular body according to the first exemplary embodiment, wherein C1 satisfies the following relational expression:

$$13.3 \leqq C1 \leqq 14.7,$$

A third exemplary embodiment of the invention is the circular body according to the first exemplary embodiment, wherein C1 satisfies the following relational expression:

$$13.6 \leqq C1 \leqq 14.4,$$

A fourth exemplary embodiment of the invention is the circular body according to any one of from the first to the third exemplary embodiments, wherein C2 satisfies the following relational expression:

$$22.0 \leqq C2 \leqq 24.5,$$

A fifth exemplary embodiment of the invention is the circular body according to any one of from the first to the third exemplary embodiments, wherein C2 satisfies the following relational expression:

$$22.5 \leqq C2 \leqq 24.0,$$

A sixth exemplary embodiment of the invention is the circular body according to any one of from the first to the fifth exemplary embodiments, satisfying the following relational expression (3):

$$50 \leqq du/(du+dl) \times 100 \leqq 80 \quad (3),$$

wherein du represents a film thickness (μm) of the outer layer and dl represents a film thickness (μm) of the inner layer.

A seventh exemplary embodiment of the invention is the circular body according to the sixth exemplary embodiment, wherein du and dl satisfy the following relational expression:

$$55 \leqq du/(du+dl) \times 100 \leqq 76,$$

A eighth exemplary embodiment of the invention is the circular body according to the sixth exemplary embodiment, wherein du and dl satisfy the following relational expression:

$$61 \leqq du/(du+dl) \times 100 \leqq 74,$$

A ninth exemplary embodiment of the invention is the circular body according to any one of from the first to the eighth exemplary embodiments, wherein a sum of a thickness of the inner layer and a thickness of the outer layer is from 50 μm to 130 μm.

A tenth exemplary embodiment of the invention is the circular body according to any one of from the first to the ninth exemplary embodiments, wherein the resin is a thermoplastic resin selected from the group consisting of polycarbonate resin, polyvinylidene fluoride resin, polyalkylene phthalate resin, a blended material of polycarbonate/polyalkylene phthalate, and an ethylenetetrafluoroethylene copolymer or a thermosetting resin selected from the group consisting of polyimide, polyamidoimide, and a copolymer of polyimide and polyamide.

A eleventh exemplary embodiment of the invention is a circular body unit, including the circular body according to any one of from the first to the tenth exemplary embodiments; and two or more of rotating members for rotatably passing therearound the circular body from an inner surface side in a state in which tension is applied.

A twelfth exemplary embodiment of the invention is an image forming apparatus, including an image support; a charging device for charging the image support; an exposure device for forming an electrostatic latent image on the image support charged by the charging device; a developing device for developing the electrostatic latent image on the image support to form a toner image; a primary transfer unit for transferring the toner image to an intermediate transfer belt; a secondary transfer unit for transferring the toner image transferred to the intermediate transfer belt to a transfer-receiving medium; and a fixing device for fixing the toner image on the transfer-receiving medium, and using the circular body according to any one of from the first to the tenth exemplary embodiments, as the intermediate transfer belt.

A thirteenth exemplary embodiment of the invention is an image forming apparatus according to the twelfth exemplary embodiment, wherein the toner image is a full color multiple toner image.

A fourteenth exemplary embodiment of the invention is an image forming apparatus according to the twelfth or the thirteenth exemplary embodiment, wherein, in the primary transfer unit, the surface of a primary transfer member touching an inner surface of the intermediate transfer belt is formed of metal.

A fifteenth exemplary embodiment of the invention is an image forming apparatus according to any one of from the twelfth to the fourteenth exemplary embodiments, wherein, in the secondary transfer unit, the surface of a secondary transfer member touching the inner surface of the intermediate transfer belt is formed of metal.

A sixteenth exemplary embodiment of the invention is an image forming apparatus according to the fourteenth or the fifteenth exemplary embodiments, wherein the metal is metal having a surface plated with nickel, copper, or chromium.

Hereinafter, preferable exemplary embodiments of the invention will be described in detail with reference to the drawings.

FIG. 1 is a schematic diagram illustrating an example (an embodiment) of the structure of an image forming apparatus according to a preferable embodiment. An image forming apparatus 100 according to the exemplary embodiment of the invention employs a so-called a tandem system. In the image forming apparatus 100, around four image supports 101*a* to 101*d* each containing an electrophotographic photoconductor, charging devices 102*a* to 102*d*, exposure devices 114*a* to 114*d*, developing devices 103*a* to 103*d*, primary transfer units (primary transfer rolls) 105*a* to 105*d*, cleaning devices 104*a* to 104*d* for image support are disposed in order along the rotation direction. In order to remove potential remaining on the surface of image supports 101*a* to 101*d* after transferring, a static eliminator may be provided.

An intermediate transfer belt 107 is passed around by tension rolls 106*a* to 106*d*, a drive roll 111, and a back up roll 108, to form a circular body unit (intermediate transfer unit) 107*b*. With these tension rolls 106*a* to 106*d*, the drive roll 111, and the back up roll 108, the intermediate transfer belt 107 can move between the respective image supports 101*a* to 101*d* and the primary transfer rolls 105*a* to 105*d* in the direction of arrow A, while touching the surface of the respective image supports 101*a* to 101*d*. Parts where the primary transfer rolls 105*a* to 105*d* touch the image supports 101*a* to 101*d* via the intermediate transfer belt 107 serve as primary transfer parts. A primary transfer voltage is applied to the touching parts between the image supports 101*a* to 101*d* and the primary transfer rolls 105*a* to 105*d*.

As a secondary transfer unit, the back up roll 108 and the secondary transfer roll 109 are disposed facing with each other via the intermediate transfer belt 107 and the secondary transfer belt 116. A transfer-receiving medium 115, such as paper, moves in the direction of arrow B between the intermediate transfer belt 107 and the secondary transfer roll 109 while touching the surface of the intermediate transfer belt 107, and then passes through a fixing device 110. A part where the secondary transfer roll 109 touches the back up roll 108 via the intermediate transfer belt 107 and the secondary transfer belt 116 serves as a secondary transfer part, and a secondary transfer voltage is applied to the touching part between the secondary transfer roll 109 and the back up roll 108. Furthermore, cleaning devices 112 and 113 for intermediate transfer belt are disposed in such a manner as to touch the intermediate transfer belt 107 after transferring.

According to the fill color image forming apparatus 100 constituted as described above, the surface of the image support 101*a* is uniformly charged by the charging device 102*a* while rotating in the direction of arrow C, and then an electrostatic latent image of a first color is formed by the exposure device 114*a*, such as a laser beam. The formed electrostatic latent image is developed (development) with a toner by the developing device 103*a* accommodating a toner corresponding to the color to form a toner image. The developing devices 103*a* to 103*d* each accommodate a toner (e.g., yellow, magenta, cyan, or black) corresponding to the electrostatic latent image of each color, respectively.

The toner image formed on the image support 101*a* is electrostatically transferred (primary transfer) to the intermediate transfer belt 107 by the primary transfer roll 105*a* in passing the primary transfer part. Thereafter, to the intermediate transfer belt 107 carrying the toner image of a first color, toner images of second, third, and fourth colors are sequentially primarily transferred in an overlapping manner by the primary transfer rolls 105*b* to 105*d*, to finally obtain a full-color multiple toner image.

The multiple toner image formed on the intermediate transfer belt 107 is electrostatically transferred collectively to the transfer-receiving medium 115 in passing the secondary transfer part. The transfer-receiving medium 115 to which the toner image has been transferred is conveyed to the fixing device 110 to be fixed by heating and/or applying pressure, and then discharged outside the unit.

In the image supports 101*a* to 101*d* after primary transfer, a residual toner is removed by the cleaning devices 104*a* to 104*d* for image support. In contrast, in the intermediate transfer belt 107 after secondary transfer, a residual toner is removed by the cleaning devices 112 and 113 for intermediate transfer belt. Then, the intermediate transfer belt 107 after secondary transfer prepares for the following image formation process.

[Intermediate Transfer Belt]

In an image forming apparatus using an intermediate transfer belt, there are problems in that a region where a toner image is omitted (minute white spots) may be generated on an output image and that a scale-like density unevenness may occur on an output image.

The present inventors found that the phenomenon that minute white spots generate is caused by electric charges flowing into the intermediate transfer belt from a primary transfer member touching the inner surface of the intermediate transfer belt in a primary transfer unit and a secondary transfer member touching the inner surface of the intermediate transfer belt in a secondary transfer unit. More specifically, in the case where the electric charges flowing into the intermediate transfer belt flows through the inside of the intermediate transfer belt to reach the outer peripheral surface, a path of current due to discharge is formed from the inner surface to the outer surface of the intermediate transfer belt, increasing current due to discharge (which is referred to hereinafter as discharge current in some cases). The present inventors found that the increase in discharge current causes generation of minute white spots.

Moreover, the present inventors found that the minute white spots due to the increase in discharge current have become a remarkable problem as applied voltage increases because of a high process rate, for example.

The present inventors found that the phenomenon that a scale-like density unevenness occurs is caused by electrical discharge occurring between the secondary transfer member touching the inner surface of the intermediate transfer belt and the inner circumferential surface of the intermediate transfer belt in the secondary transfer unit. More specifically, the present inventors found that positive electric charges accumulate on the inner circumferential surface of the intermediate transfer belt due to electrical discharge, and flow inside the intermediate transfer belt to reach a surface, without spreading in the direction of the inner circumferential surface, whereby scale-like density unevenness occurs corresponding to the distribution of the flowed charge.

Accordingly, the intermediate transfer belt (circular body) of the exemplary embodiment of the invention has the following characteristics.

—Containing of Polyaniline and Carbon Black—

In the exemplary embodiment of the invention, the intermediate transfer belt 107 is required to contain at least an inner layer containing resin and an outer layer that is laminated on an outer circumferential surface side of the inner layer and contains resin; contain, as a conductive agent, polyaniline in the outer layer and carbon black in the inner layer; and satisfy the following relational expressions (1) and (2):

$$13.0 \leqq C1 \leqq 15.0 \quad (1)$$

$$21.5 \leqq C2 \leqq 25.0 \quad (2),$$

wherein C1 represents the content (part by weight) of polyaniline based on 100 parts by weight of resin forming the outer layer and C2 represents the content (part by weight) of carbon black based on 100 parts by weight of resin forming the inner layer.

In the exemplary embodiments of the invention, the circular body used as the intermediate transfer belt 107 has at least the inner layer and the outer layer described above, and may further have an inner circumferential surface layer on a surface of the inner layer at an inner circumferential surface side or an outer circumferential surface layer on a surface of the outer layer at an outer circumferential surface side. Furthermore, an intermediate layer may be disposed between the inner layer and the outer layer.

By the use of polyaniline as a conductive agent to be contained in the outer layer and carbon black as a conductive agent to be contained in the inner layer, the generation of minute white spots on an output image is suppressed.

More specifically, in primary transfer members (i.e., primary transfer rolls 105*a* to 105*d*) touching the inner surface of the intermediate transfer belt 107 in the primary transfer unit and a secondary transfer member (i.e., back up roll 108) touching the inner surface of the intermediate transfer belt 107 in the secondary transfer unit, electric charges flow into the intermediate transfer belt 107. The electrons flowing into the intermediate transfer belt 107 reach the outer circumferential surface of the intermediate transfer belt 107. However, it is presumed that, by the above-described configuration, the amount of the electric charges can be suppressed, increase in discharge current is suppressed, and the generation of minute white spots is prevented.

Moreover, by controlling each of the content of polyaniline in the outer layer and the content of carbon black in the inner layer to the above-mentioned given ranges, respectively, the occurrence of scale-like density unevenness on an output image is suppressed.

More specifically, due to electrical discharge between occurring the secondary transfer member (i.e., back up roll 108) touching the inner surface of the intermediate transfer belt 107 and the inner surface of the intermediate transfer belt 107 in the secondary transfer unit, electric charges accumulated on the inner circumferential surface of the intermediate transfer belt 107 can be spread in the direction of the inner circumferential surface by the above-described configuration, whereby the occurrence of scale-like density unevenness is suppressed.

From the viewpoint of more effectively suppressing the occurrence of scale-like density unevenness, it is preferable that C1 satisfies the following relational expression:

$$13.3 \leqq C1 \leqq 14.7,$$

and it is particularly preferable that C1 satisfies the following relational expression:

$$13.6 \leqq C1 \leqq 14.4.$$

In the case of C1<13.0, a transfer electric field required and sufficient for a transfer gap is not formed in the primary transfer process and the secondary transfer process, resulting in poor transfer (reduction in density) due to lack of a transfer electric field. In contrast, in the case of 15.0<C1, electric charges flowing from the primary transfer members (i.e., primary transfer rolls 105*a* to 105*d*) touching the inner surface of the intermediate transfer belt 107 in the primary transfer process and from the secondary transfer member (i.e., back up roll 108) touching the inner surface of the intermediate transfer belt 107 in the secondary transfer process cannot be sufficiently suppressed, resulting in the generation of minute white spots.

It is preferable that C2 satisfies the following relational expression:

$$22.0 \leqq C2 \leqq 24.5,$$

and it is particularly preferable that C2 satisfies the following relational expression:

$$22.5 \leqq C2 \leqq 24.0.$$

In the case of C2<21.5, electrical discharge occurring between the inner circumferential surface of the intermediate transfer belt 107 and the secondary transfer member (i.e., back up roll 108) in the secondary transfer process makes it impossible to sufficiently spread electric charges accumulated on the inner circumferential surface of the intermediate transfer belt 107, resulting in the occurrence of scale-like density unevenness. In contrast, in the case of 25.0<C2, electric charges accumulated on the inside of the outer layer cannot be sufficiently prevented from flowing into the outer circumferential surface of the intermediate transfer belt 107, resulting in the occurrence of HT unevenness.

—Film Thickness—

In the exemplary embodiment of the invention, it is preferable that the intermediate transfer belt 107 satisfy the following relational expression (3):

$$50 \leqq du/(du+dl) \times 100 \leqq 80 \quad (3),$$

wherein du represents the film thickness (μm) of the outer layer and dl represents a film thickness (μm) of the inner layer.

Here, in the secondary transfer process, electric charges flowing from the secondary transfer member (i.e., back up roll 108) touching the inner surface of the intermediate transfer belt 107 are poured in the outer layer, and the electric charges are locally accumulated on the outer layer of the intermediate transfer belt 107 to locally generate electric field (which is referred to as "a local electric field" in some cases). In a case where electric field strength of the local electric field exceeds the threshold, the electric charges flow to the outer circumferential surface of the intermediate transfer belt 107 at the same time to generate electrical discharge between the outer circumferential surface of the intermediate transfer belt 107 and the secondary transfer roll 109. The present inventors found that, a region where a toner image is omitted (HT unevenness) generates on the output image, since a toner of a discharge area is charged with reverse polarity, and thereby, is not transferred to a transfer-receiving medium.

In contrast, in a case where the relational expression (3) is satisfied, the occurrence of HT unevenness is suppressed. More specifically, by controlling the ratio of the film thickness of the outer layer (du) to the film thickness of the inner layer (dl) within the given range as mentioned above (controlling to du/(du+dl)×100≦80), the amount of the electric charges accumulated on the inside of the outer layer is reduced, the amount of the electric charges flowing to the outer circumferential surface of the intermediate transfer belt 107 at the same time is reduced, and the occurrence of HT unevenness is prevented.

In a case where the relational expression (3) is satisfied, the generation of minute white spots is suppressed. More specifically, by controlling the ratio of the film thickness of the outer layer (du) to the film thickness of the inner layer (dl) within the given range as mentioned above (controlling to 50≦du/(du+dl)×100), the amount of the electric charges flowing into the intermediate transfer belt 107 to reach the outer circumferential surface of the intermediate transfer belt 107 can be reduced, the increase in discharge current is suppressed, and the generation of minute white spots is prevented.

It is preferable that du and dl satisfy the following relational expression:

$$55 \leqq du/(du+dl) \times 100 \leqq 76,$$

and it is more preferable that du and dl satisfy the following relational expression:

$$61 \leqq du/(du+dl) \times 100 \leqq 74.$$

Based on the fact that in a case where du and dl satisfy a relational expression of $50 \leqq du/(du+dl) \times 100$, the electric charges accumulated on the inside of the outer layer are prevented from flowing into the outer circumferential surface of the intermediate transfer belt 107 at the same time, whereby the occurrence of HT unevenness is effectively prevented, and thus a favorable output image is obtained. Based on the fact that in a case where du and dl satisfy a relational expression of $du/(du+dl) \times 100 \leqq 80$, a transfer electric field required and sufficient for a transfer gap is formed in the primary transfer process and the secondary transfer process, poor transfer (reduction in density) due to lack of a transfer electric field is prevented, and thus a favorable output image is obtained.

In the circular body used as the intermediate transfer belt 107 in the exemplary embodiment in the invention, the sum of a thickness of the inner layer and a thickness of the outer layer is preferably from 50 μm to 130 ∞m. In a case where the sum of thickness is 50 μm or more, sufficient mechanical strength can be held and a more favorable output image can be obtained even with a long term use in an image forming apparatus. In a case where the sum of thickness is 130 μm or less, sufficient flexibility can be held, and even when the intermediate transfer belt is passed around over a long period of time in an image forming apparatus, the intermediate transfer belt shows no sign of being passed around, and a more favorable output image can be obtained.

As resin contained in the inner layer and the outer layer in the intermediate transfer belt 107, for example, a substance obtained by dissolving or dispersing a conductive agent in a thermoplastic resin, such as polycarbonate resin, polyvinylidene fluoride resin, polyalkylene phthalate resin, a blended material of polycarbonate/polyalkylene phthalate, or an ethylene tetrafluoroethylene copolymer; or in a thermosetting resin, such as polyimide, polyamidoimide, or a copolymer of polyimide and polyamide (polyamidoimide) is used.

In the intermediate transfer belt 107 of the exemplary embodiment of the invention, polyaniline is contained as a conductive agent in the outer layer.

In the inner layer, carbon black is contained as a conductive agent. As the carbon black, a conventionally known substance can be used, and carbon black whose surface has been subjected to oxidation treatment is particularly preferably used.

—Inner Circumferential Surface Layer, Outer Circumferential Surface Layer, and Intermediate Layer—

As described above, in the exemplary embodiment of the invention, the circular body used as the intermediate transfer belt 107 has at least the inner layer and the outer layer described above, and may further have an inner circumferential surface layer on a surface of the inner layer at an inner circumferential surface side or an outer circumferential surface layer on a surface of the outer layer at an outer circumferential surface side. Furthermore, an intermediate layer may be disposed between the inner layer and the outer layer.

As materials of the inner circumferential surface layer and outer circumferential surface layer, for example, materials used for the inner layer and the outer layer are used. Other than these, those obtained by dispersing particles of fluororesin in fluororesin, silicone resin, urethane resin, fluorine-modified resin, or matrix resin, and the like are also used.

Fluororesin, such as tetrafluoroethylene resin, hexafluoropropylene resin, a tetrafluoroethylene-perfluoroalkoxyethylene copolymer or polyvinylidene fluoride resin, curing type silicone resin, and the like are preferably used.

Further, materials in which particles made of stearic acid salt metal soap, fatty acid amide, a tetrafluoroethylene-perfluoroalkoxyethylene copolymer, graphite fluoride, boron nitride, silicon nitride, silicon nitride resin, silicone resin, polyolefin resin, silicone rubber, metal, metal oxide, or the like are dispersed in polyphenyl sulfone resin, polysulfone resin polyether sulfone resin, polyester resin, polyacetal resin, polyarylate resin, polyamide resin, polycarbonate resin, polyphenylene ether resin, polyether imide resin, polyamidoimide resin, polyphenylene sulfide resin, polyimide resin or the like may also be used. Furthermore, silicone oil may be added to the above material.

It is preferred that the inner circumferential surface layer and the outer circumferential surface layer contain, as a conductive agent, carbon black or polyaniline.

From the viewpoints of more effectively exerting the effect of suppressing image quality defects such as minute white spots and scale-like density unevenness, it is preferred that inner circumferential surface layer and the outer circumferential surface layer are not too thick, and specifically, the thickness of the inner circumferential surface layer and the thickness of the outer circumferential surface layer are each preferably 10 μm or less, and particularly preferably 5 μm or less.

As a material of the intermediate layer, for example, materials used for the inner layer and the outer layer are used. Other than these, rubber materials such as EPDM rubber (ethylene propylene diene rubber), SBR (styrene butadiene rubber), NBR (nitrile butadiene rubber), acrylonitrile-butadiene-styrene rubber, fluorine-containing rubber, silicone rubber, urethane rubber, acrylic rubber, isoprene rubber, chloroprene rubber, butyl rubber, epichlorohydrin rubber, and norbornene rubber are also used.

Further, polyphenyl sulfone resin, polysulfone resin, polyether sulfone resin, polyester resin, polyacetal resin, polyarylate resin, polyamide resin, polycarbonate resin, polyphenylene ether resin, polyether imide resin, polyamidoimide resin, polyphenylene sulfide resin, polyimide resin, and the like may also be used.

It is preferred that the intermediate layer contains, as a conductive agent, carbon black or polyamine.

From the viewpoints of more effectively exerting the effect of suppressing image quality defects such as minute white spots and scale-like density unevenness, it is preferred that the intermediate layer is not too thick, and specifically, a thickness of the intermediate layer is preferably 10 μm or less, and particularly preferably 5 μm or less.

Figure 2:
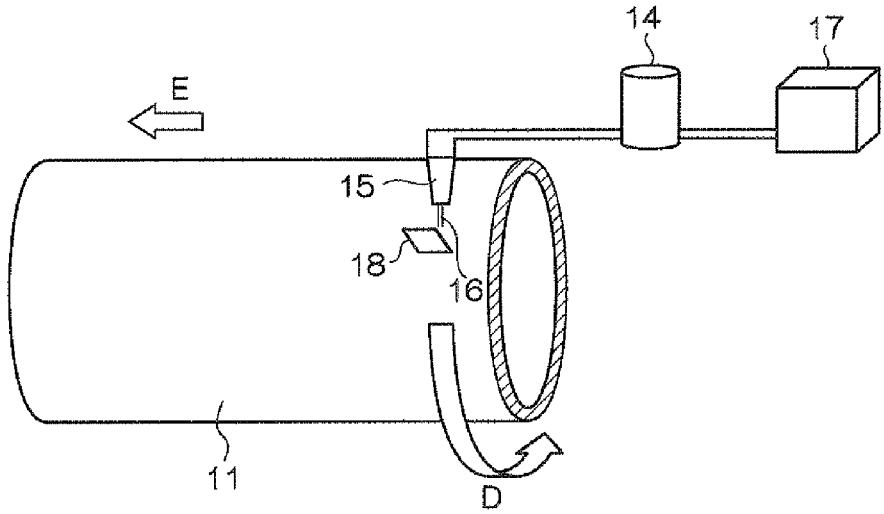
FIG. 2 is a schematic configuration cross sectional view illustrating an embodiment of a cylindrically molded tube outer circumferential surface coating device to be used for producing an intermediate transfer belt of the present invention.

There is no particular limitation on a method of producing the intermediate transfer belt 107 according to the exemplary embodiment of the invention. For example, the intermediate transfer belt 107 can be preferably produced using a polyimide precursor solution by a spin coating method as shown in FIG. 2.

According to this method, a cylindrically molded tube 11 having an outer diameter corresponding to the length of the intermediate transfer belt 107 is prepared. A nozzle 15 for discharging a coating solution 16 to the outer circumferential surface of the cylindrically molded tube 11 is disposed at a place along the outer circumferential surface of the cylindrically molded tube 11. The nozzle 15 is connected to a coating solution container 14 through a pipe. The coating solution container 14 is connected to a pressure device 17 through a pipe. A blade 18 for leveling the discharged coating solution 16 to the outer circumferential surface of the cylindrically molded tube 11 is disposed below the nozzle 15.

A method of producing an intermediate transfer belt 107 consisting of two layers of the inner layer and the outer layer, as the intermediate layer 107, is to be explained.

The cylindrically molded tube 11 is rotated in the rotating direction (arrow D) of the cylindrically molded tube, the coating solution (coating solution for inner layer) 16 is discharged to the outer circumferential surface of the cylindrically molded tube 11 from the nozzle 15, and the discharged coating solution 16 is leveled by the blade 18 on the outer circumferential surface of the cylindrically molded tube 11. The nozzle 15 and the blade 18 move at a constant rate in the moving direction (arrow E) of the nozzle and the blade, and the coating solution 16 is applied with a uniform thickness to the outer circumferential surface of the cylindrically molded tube 11. The coating solution 16 is adjusted by the pressure device 17 in such a manner that a fixed amount thereof is discharged from the nozzle 15. Thus, a coating film of the coating solution 16 is formed on the outer circumferential surface of the cylindrically molded tube 11.

The obtained coating film of the coating solution 16 is dried by heating to form the inner layer, and then an application/drying process is repeated using the coating solution (coating solution for outer layer) 16, thereby obtaining a desired constitutive film. Thereafter, cooling is performed to separate the constitutive film from the cylindrically molded tube 11, and the constitutive film is cut into a given width, whereby the intermediate transfer belt 107 can be obtained.

In a case where a polyimide precursor is used as a resin material of the coating solution (coating solution for inner layer and coating solution for outer layer) 16, the coating film of the coating solution 16 is formed on the outer circumferential surface of the cylindrically molded tube 11, dried at from 80° C. to 170° C. to remove the solvent (drying process), and further heated to from 250° C. to 350° C. for imide conversion (baking process) to form a polyimide resin film. In the exemplary embodiment of the invention, the inner layer and the outer layer are formed (repetition of application/drying process), and then a baking process is performed, whereby a desired constitutive film can be obtained.

In the case where resin other than polyimide resin is employed as resin used for the intermediate transfer belt 107, conditions such as temperature and time for drying are suitably adjusted, and repetition of application/drying process as described above is performed, whereby a desired structure film is obtained.

In the case of the structure including an intermediate layer as described above, the intermediate layer can be formed by repeating the process of applying a coating solution for intermediate layer and drying, after formation of inner layer and before formation of outer layer.

Further, in the case of the structure including an inner circumferential surface layer and/or an outer circumferential surface layer as described above, the inner circumferential surface layer can be formed by repeating the process of applying a coating solution for inner circumferential surface layer and drying, before formation of inner layer; and the outer circumferential surface layer can be formed by repeating the process of applying a coating solution for outer circumferential surface layer and drying, after formation of inner layer and outer layer.

The solid content of the coating solution 16 can be adjusted to from 10% by weight to 40% by weight and the viscosity thereof can be adjusted to from 1 Pa·s to 100 Pa·s, for example. In the coating solution 16, a given amount of conductive particles of, for example, polyaniline or carbon black, according to a required surface resistivity of the intermediate transfer belt, is dispersed. Examples of a dispersion method include known methods using a jet mill, a roll mill, a ball mill, a vibration ball mill, an attritor, a sand mill, a colloid mill, or a paint shaker.

The thickness of the intermediate transfer belt 107 can be adjusted according to the discharge amount of the coating solution 16, the movement rate of each of the nozzle 15 and the blade 18, and the solid content of the coating solution 16. It is preferable that the thickness of the intermediate transfer belt 107 be from 50 μm to 130 μm from the viewpoint of maintaining dimensional accuracy or the like also even when image output is repeated.

[Image Support]

As image supports 101*a* to 101*d*, a known electrophotographic photoconductor is widely applicable. As an electrophotographic photoconductor, an inorganic photoconductor in which a photosensitive layer is formed of an inorganic material, an organic photoconductor in which a photosensitive layer is formed of an organic material, etc., can be used. In an organic photoconductor, a function-separated type organic photoconductor in which a charge generating layer which generates electric charge by exposure to light and a charge transport layer which transports electric charge are laminated or a single-layer organic photoconductor in which the one and same layer fulfills the function of generating electric charge and the function of transporting electric charge is preferably used. In an inorganic photoconductor, a photoconductor in which a photosensitive layer is formed of amorphous silicon is preferably used.

There is no particular limitation on the shape of the image support, and, for example, known shapes, such as a cylindrical drum shape, a sheet shape, or a plate shape, can be employed.

[Charging Device]

There is no particular limitation on the charging devices 102*a* to 102*d*, and, for example, known charging units, such as a contact type charging unit using a conductive (here, "conductive" means that a volume resistivity is lower than $10^7$ Ω·cm, for example. In this specification, the same applies unless otherwise specified.) or semiconductive (here, "semiconductive" means that a volume resistivity is from $10^7$ Ω·cm to $10^{13}$ Ω·cm, for example. In this specification, the same applies unless otherwise specified,) roller, brush, film, rubber blade, etc.; a scorotron charging unit or a corotron charging unit utilizing corona discharge; etc., can be widely applied. Among the above, a contact type charging unit with which the generation amount of ozone is reduced and charging is efficiently performed is preferable.

The charging devices 102*a* to 102*d* usually apply a direct current to the image supports 101*a* to 101*d*, and may apply an alternating current while being superimposed.

[Exposure Device]

There is no particular limitation on the exposure devices 114*a* to 114*d*, and, for example, known exposure devices, such as optical system devices with which the surface of the image supports 101*a* to 101*d* can be exposed to light, in a desired image shape, from light sources, such as a semiconductor laser beam, LED light, and liquid crystal shutter light, or via a polygon mirror from the light sources, are widely applicable.

[Developing Device]

The developing devices 103*a* to 103*d* can be selected according to the purpose. For example known developing units with which development is performed by contacting or non-contacting a one component developer or a two component developer using a brush, a roll, etc., are mentioned.

A toner (developer) for use in the image forming apparatus 100 of the exemplary embodiment of the invention is not particularly limited, and, for example, contains a binding resin and a colorant.

Examples of the binding resin include homopolymers and copolymers of styrenes, monoolefins, vinyl esters, α-methylene aliphatic monocarboxylic acid esters, vinyl ethers, and vinyl ketones. In particular, typical examples of the binding resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Furthermore, examples include polyester, polyurethane, epoxy resin, silicone resin, polyamide, modified rosin, and paraffin wax.

Typical examples of the colorant include magnetic powder, such as magnetite and ferrite, carbon black, aniline bule, chalco oil blue, chrome yellow, ultra marine blue, Dupont oil red, quinoline yellow, methylene blue chloride, phthalocyanine blue, malachite green oxalate, lamp black, rose bengal, C. I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Known additives such as a charge control agent, a mold releasing agent, and other inorganic particles may be internally or externally added to the toner.

The typical examples of the mold releasing agent include low-molecular polyethylene, low-molecular polypropylene, Fischer-Tropsch wax, montan wax, carnauba wax, rice wax, and candelilla wax.

As the charge control agent, known agents such as azo-based metal complex compounds, metal complex compounds of salicylic acid, and resin-type charge control agents or the like having a polar group may be used.

As other inorganic particles, small diameter inorganic particles having an average primary particle diameter of 40 nm or less may be used for the purpose of controlling powder mobility, charge control or the like, and as necessary, larger inorganic or organic particles may be used in combination for the purpose of reducing adhesion. Such other inorganic particles may be known particles.

Furthermore, surface treatment of the small diameter inorganic particle is effective since it increases the dispersibility and powder mobility of the particles.

The toner for use in the exemplary embodiment of the invention is preferably manufactured by a polymerization method such as an emulsion polymerization aggregation method or a dissolution suspension method from the viewpoint of high shape controllability. Furthermore, the toner obtained by the above method may be used as the core to which aggregated particles are attached, followed by heating and fusion, to let the toner have a core-shell structure.

In a case where an external additive is added, the toner and the external additive can be mixed with a Henschel mixer, a V blender or the like. Furthermore, in a case where the toner is manufactured by a wet process, the external additive may be added by a wet process.

[Primary Transfer Roll]

The primary transfer rolls 105*a* to 105*d* may be a single layer structure or a multilayer structure. For example, in the case of a single layer structure, the primary transfer roll contains a roll in which a suitable amount of conductive particles, such as carbon black, has been blended in a foamed or non-foamed silicone rubber, urethane rubber, EPDM (ethylene propylene diene M-class rubber), or the like.

Moreover, as the primary transfer rolls 105*a* to 105*d,* a roll whose surface is formed of metal is also used. The primary transfer roll whose surface is formed of metal is preferable in terms of excellent environmental variation resistance, suppressed increase in roll resistance with time, power source capacity, and electric current value control. Conventionally, in a case where a roll whose surface is formed of metal is used as the primary transfer roll, such a roll has had a disadvantage that image quality defects, such as minute white spots, due to increase in discharge current are likely to occur.

In contrast, by the application of the intermediate transfer belt 107 according to the exemplary embodiment of the invention, generation of minute white spots is suppressed even when the primary transfer rolls 105*a* to 105*d* whose surface is formed of metal are used.

As metal forming the surface of the primary transfer rolls 105*a* to 105*d,* known metals, such as SUS (stainless steel), iron, and aluminum, can be used. In particular, rolls whose surface has been plated with nickel, copper, or chromium, are preferable.

[Cleaning Device for Image Support]

The cleaning devices from 104*a* to 104*d* for image support remove a residual toner adhering to the surface of the image supports 101*a* to 101*d* after the primary transfer process, and, besides a cleaning blade, brush cleaning, roll cleaning, etc., can be used. Among the above, the use of a cleaning blade is preferable. Examples of a material of a cleaning blade include urethane rubber, neoprene rubber, silicone rubber and the like.

[Secondary Transfer Roll]

There is no particular limitation on the layer structure of the secondary transfer roll 109, and, for example, in the case of a three-layer structure, the secondary transfer roll 109 contains a core layer, an intermediate layer, and a coating layer covering the surface. The core layer is a foamed body of silicone rubber, urethane rubber, EPDM or the like in which conductive particles have been dispersed. The intermediate layer is formed of a non-foamed body thereof. Examples of a material of the coating layer include a tetrafluoroethylene-hexafluoropropylene copolymer and perfluoroalkoxy resin. The volume resistivity of the secondary transfer roll 109 is preferably $10^7$ Ωcm or lower. A two-layer structure, excluding the intermediate layer, is also acceptable.

[Back Up Roll]

The back up roll 108 forms a counter electrode of the secondary transfer roll 109. The layer structure of the back up roll 108 may be a single layer structure or a multilayer structure. For example, in the case of a single layer structure, the back up roll 108 contains a roll in which a suitable amount of conductive particles, such as carbon black, has been blended in silicone rubber, urethane rubber, EPDM, or the like. In the case of a two-layer structure, the back up roll 108 contains a roll in which the outer circumferential surface of an elastic layer formed of a rubber material mentioned above has been covered with a high resistance layer.

As the back up roll 108, a roll whose surface is formed of metal is also used. The back up roll whose surface is formed of metal is preferable in terms of excellent environmental variation resistance, suppressed increase in roll resistance with time, power source capacity, and electric current value control. Conventionally, in a case where a roll whose surface is formed of metal is used as the back up roll, such a roll has had a disadvantage that image quality defects, such as minute white spots, due to increase in discharge current are likely to occur.

In contrast, by the application of the intermediate transfer belt 107 according to the exemplary embodiment of the invention, generation of minute white spots is suppressed even when the back up roll 108 whose surface is formed of metal is used.

As the metal forming the surface of the back up roll 108, known metals, such as SUS, iron, and aluminum, can be used. In particularly, rolls whose surface has been plated with nickel, copper, or chromium, are preferable.

In general, voltage of from 1 kV to 6 kV is applied to between shafts of the back up roll 108 and the secondary transfer roll 109. In place of the application of voltage to between the shaft of the back up roll 108, and the secondary transfer roll 109, voltage can also be applied to between an electrode member, which has good electrical conductivity and is brought into contact with the back up roll 108, and the secondary transfer roll 109. Examples of the above-mentioned electrode member include a metal roll, a conductive rubber roll, a conductive brush, a metal plate, a conductive resin plate and the like.

[Fixing Device]

As a fixing device 110, known fixing units, such as a heat roller fixing unit, a pressure roller fixing unit, a flash fixing unit, etc., are widely applicable.

[Cleaning Device for Intermediate Transfer Belt]

As the cleaning devices 112 and 113 for intermediate transfer belt, a cleaning blade, as well as a cleaning brush, and a cleaning roll may be used. Among these, a cleaning blade is preferable. Examples of a material of the cleaning blade include urethane rubber, neoprene rubber, and silicone rubber.

In the above-described embodiments, the description is given to the case of a so-called tandem type image forming apparatus containing a plurality of image supports, but a so-called plural cycles-including image forming apparatus (e.g., 4-cycle image forming apparatus) which contains one image support and in which the intermediate transfer belt rotates and forms an image according to the number of colors is also acceptable.

Further, in the above-described embodiments, embodiments in which the circular body that has at least an inner layer and an outer layer and may further have an inner circumferential surface layer, an outer circumferential surface layer or an intermediate layer is used as an intermediate transfer belt 107 are described, but the circular body is also used as a base material of an intermediate transfer belt 107. Specifically, a laminated body which is obtained by providing an elastic layer, a protective layer or the like on a surface of the circular body, as a base material, at an outer circumferential surface side may also be used as the intermediate transfer belt 107.

Concerning the elastic layer, examples of a material of the elastic layer include elastomer such as EPDM rubber (ethylene propylene diene rubber), SBR (styrene butadiene rubber), NBR (nitrile butadiene rubber), acrylonitrile-butadiene-styrene rubber, urethane rubber, acrylic rubber, isoprene rubber, chloroprene rubber, butyl rubber, norbornene rubber, fluorine-containing rubber, silicone rubber, acrylonitrile-butadiene rubber, ethylene rubber, epichlorohydrin rubber, or polyurethane elastomer, and resin which exhibits elasticity structurally by inserting bubble inside thereof.

A thickness of the elastic layer is generally, preferably, from 20 μm to 500 μm.

Concerning the protective layer, examples of a material of the protective layer include those obtained by dispersing particles of fluororesin in fluororesin, silicone resin, urethane resin, fluorine-modified resin, or matrix resin, and the like.

Further, fluororesin such as tetrafluoroethylene resin, hexafluoropropylene resin, a tetrafluoroethylene-perfluoroalkoxyethylene copolymer or polyvinylidene fluoride resin, curing type silicone resin, polyphenyl sulfone resin, polysulfone resin, polyether sulfone resin, polyester resin, polyacetal resin, polyarylate resin, polyamide resin, polycarbonate resin, polyphenylene ether resin, polyether imide resin, polyamidoimide resin, polyphenylene sulfide resin, polyimide resin, and the like are also used for the protective layer.

A thickness of the protective layer is generally, preferably, from 1 μm to 100 μm.

EXAMPLES

Hereinafter, examples and comparative examples will be described, but the present invention is not limited to the following examples.

Example 1

(Production of Intermediate Transfer Belt)

—Carbon Black Dispersed Polyimide Precursor Solution for Inner Layer—

First, to an NMP (N-methyl-2-pyrrolidinone) solution (solid content after imide conversion: 18% by weight) of polyamic acid containing 3,3',4,4'-biphenyltetracarboxylic dianhydride and 4,4'-diaminodiphenyl ether, carbon black (Special Black 4: manufactured by Degussa) is added in such a manner that the amount becomes 80 parts by weight with respect to 100 parts by weight of the solid content of polyamic acid. Then, using a jet mill disperser (Geanus PY [Smallest-part sectional area of impart part: 0.032 $mm^2$]: manufactured by Geanus), the mixture is made to pass through a dispersion unit part 5 times at a pressure of 200 MPa for dispersion/mixing, thereby obtaining a dispersion liquid (A).

Subsequently, to the obtained dispersion liquid (A), an NMP solution (solid content after imide conversion: 18% by weight) of polyamic acid containing 3,3',4,4'-biphenyltetracarboxylic dianhydride and 4,4'-diaminodiphenyl ether is added in such a manner that the amount of carbon black becomes 23.0 parts by weight with respect to 100 parts by weight of polyamic acid. Then, the mixture is mixed/stirred using a planetary mixer (Aikoh mixer: manufactured by Aicohsha Manufacturing Co., Ltd.), thereby preparing a carbon black dispersed polyimide precursor solution for inner layer.

—Polyaniline Dispersed Polyimide Precursor Solution for Outer Layer—

An NMP solution (solid content after imide conversion: 18% by weight) of polyamic acid containing 3,3',4,4'-biphenyl tetracarboxylic dianhydride and 4,4'-diaminodiphenylether is added in such a manner that the amount of polyaniline becomes 13.0 parts by weight with respect to 100 parts by weight of polyamic acid. Then, the mixture is mixed/stirred using a planetary mixer (Aikoh mixer: manufactured by Aicohsha Manufacturing Co., Ltd.), thereby preparing a polyaniline dispersed polyimide precursor solution for outer layer.

—Formation of Inner Layer—

As a cylindrically molded tube 11 shown in FIG. 2, an aluminum cylindrical body having an outer diameter of 366 mm and a length of 650 mm is prepared. The aluminum cylindrical body is subjected to surface cutting to adjust the outer diameter to 366 mm, and then subjected to blasting by spherical glass particles for surface roughening to adjust the surface roughness Ra to 0.40 μm. A silicone mold releasing agent (tradename: KS700, manufactured by Shin-Etsu Chemicals Co., Ltd.) is applied to the surface of the cylindrically molded tube 11, and baked at 300° C. for 1 hour, thereby producing an aluminum cylindrical body. Furthermore, as a spin coating process, the cylindrically molded tube 11 is rotated in the direction of arrow D at 40 rpm while horizontally placing the axis of the cylindrically molded tube 11 as shown in FIG. 2. A blade 18 is made of SUS having a width of 20 mm and a thickness of 0.5 mm, and has elasticity. The blade 18 is pressed against the cylindrically molded tube 11, and then the carbon black dispersed polyimide precursor solution for inner layer is extruded, as a polyimide precursor solution 16, from a container 14 through a nozzle 15 having an opening diameter of 2 mm. When the polyimide precursor solution 16 passes the blade 18, the blade 18 is pushed to form a gap between the blade 18 and the cylindrically molded tube 11. Subsequently, the nozzle 15 and the blade 18 are transferred in the direction of arrow E at a rate of 120 mm/minute. In applying, the solution is not applied to regions each having a width of 20 mm at the ends of the cylindrically molded tube 11. Next, the cylindrically molded tube 11 to which the carbon black dispersed polyimide precursor solution for inner layer has been applied is dried by heating at 120° C. for 25 minutes while rotating at 6 rpm still in a horizontal state, thereby obtaining a dried film of the carbon black dispersed polyimide precursor for inner layer. The amount of the solution extruded from the nozzle 15 at the time of application is adjusted so that the film thickness after imidization, mentioned later, of the dried film of the carbon black dispersed polyimide precursor for inner layer is 33 μm. The amount of a remaining NMP in the dried film of the carbon black dispersed polyimide precursor for inner layer is 31% by weight.

—Formation of Outer Layer—

To the surface of the cylindrically molded tube 11 on which the dried film of the carbon black dispersed polyimide precursor for inner layer is formed, the polyaniline dispersed polyimide precursor solution for outer layer is applied by the method described in the description of the formation of the inner layer.

Next, the cylindrically molded tube 11 to which the polyaniline dispersed polyimide precursor solution for outer layer has been applied is dried by heating at 120° C. for 25 minutes while rotating at 6 rpm still in a horizontal state, thereby obtaining a dried film of the polyaniline dispersed polyimide precursor for outer layer. The amount of the solution extruded from the nozzle 15 at the time of application is adjusted so that the film thickness after imidization, mentioned later, of the dried film of the polyaniline dispersed polyimide precursor for outer layer is 67 μm.

The cylindrically molded tube 11 in which the dried film of the polyaniline dispersed polyimide precursor for outer layer is laminated on the obtained dried film of the carbon black dispersed polyimide precursor for inner layer is heated at 200° C. for 30 minutes, at 260° C. for 30 minutes, and at 290° C. for 50 minutes to form a polyaniline/carbon black dispersed polyimide film. Thereafter, the temperature of the cylindrically molded tube 11 is cooled to room temperature (25° C.), and a polyimide resin film is separated from the cylindrically molded tube 11. The obtained polyimide resin film is cut into a width of 362 mm, thereby obtaining an intermediate transfer belt having a two-layer structure consisting of inner layer and outer layer. Two sheets of the obtained intermediate transfer belt are connected to form an intermediate transfer belt having a circumferential length of 2111 mm.

The surface resistivity of the obtained intermediate transfer belt is 10.07 Log Ω/□ and the volume resistivity thereof is 11.02 Log Ω·cm. The surface resistivity and the volume resistivity are measured by measuring 20 points in the process direction of the intermediate transfer belt and 4 points in the vertical direction relative to the process direction (80 points in total), and calculating the average.

Examples 2 to 30 and Comparative Examples 1 to 8

Intermediate transfer belts of Examples 2 to 30 and Comparative Examples 1 to 8 are produced by the method described in Example 1, except adjusting the film thickness of the outer layer (du), the film thickness of the inner layer (dl), the content C1 of polyaniline (PAn) in the outer layer, and the content C2 of carbon black (CB) in the inner layer in Example 1 to the values listed in Tables 1 and 2. The surface resistivity and the volume resistivity of each intermediate transfer belt are shown in Tables 1 and 2.

Intermediate transfer belt of Example 29 is produced by the method described in Example 6, except adjusting the film thickness of the outer layer (du) in Example 6 to the value listed in Table 2, and further forming an outer circumferential surface layer having a thickness of 5 μm on a surface of the outer layer at an outer circumferential surface side.

—Method of Forming Outer Circumferential Surface Layer—

An outer circumferential surface layer is formed by the method which is applied to the formation of the outer layer in Example 6, except using a solution prepared so that the content of carbon black of the carbon black dispersed polyimide precursor solution for inner layer used for the formation of the inner layer in Example 6 would be 22 parts by weight with respect to 100 parts by weight of polyamic acid.

The surface resistivity and the volume resistivity of the intermediate transfer belt are shown in Table 2.

Intermediate transfer belt of Example 30 is produced by the method described in Example 7, except adjusting the film thickness of the outer layer (du) in Example 7 to the value listed in Table 2, and further forming an inner circumferential surface layer having a thickness of 5 μm on a surface of the inner layer at an inner circumferential surface side.

—Method of Forming Inner Circumferential Surface Layer—

An inner circumferential surface layer is formed by the method which is applied to the formation of the inner layer in Example 7, except using a solution prepared so that the content of polyaniline of the polyaniline dispersed polyimide precursor solution for outer layer used for the formation of the outer layer in Example 7 would be 15.4 parts by weight with respect to 100 parts by weight of polyamic acid. Thereafter, an inner layer and an outer layer were formed by the method described in Example 7 on an outer circumferential surface side of the inner circumferential surface layer.

The surface resistivity and the volume resistivity of the intermediate transfer belt are shown in Table 2.

(Measurement of Surface Resistivity ρs)

Figure 3:
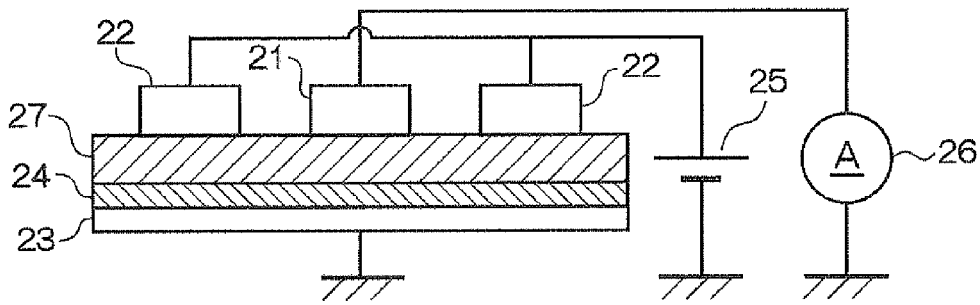
FIG. 3 is a cross-sectional schematic diagram of a surface resistivity meter for the intermediate transfer belt of the present invention.

FIG. 3 is a cross-sectional schematic diagram of a surface resistivity meter. An insulating sheet 24 is located on a rear electrode 23 connected to GND, and a measurement sample 27 is further located thereon. A surface electrode 21 and a guard electrode 22 are located on the measurement sample 27, and the measurement sample 27 is sandwiched by the rear electrode 23 and the surface electrode 21 and the guard electrode 22 via the insulating sheet 24 to form a sandwich structure. A direct current voltage is applied by a direct current power source 25 connected to the guard electrode 22, and the amount of flowing current is measured by a microammeter 26 connected to the surface electrode 21 to calculate the surface resistivity.

Figure 5:
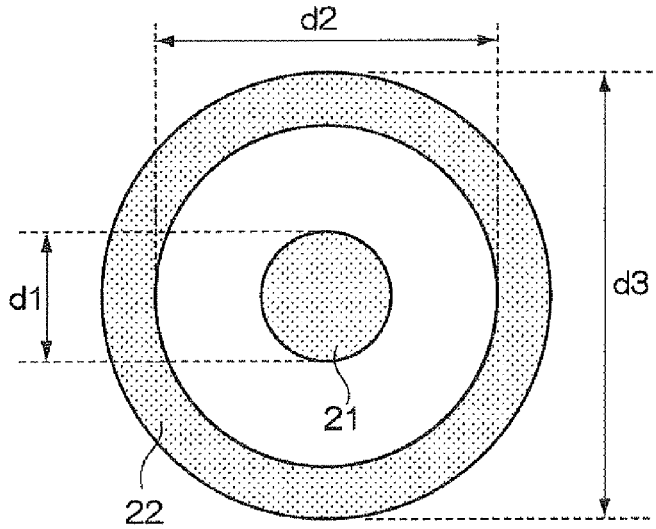
FIG. 5 is a top view schematic diagram of an electrode for use in the surface resistivity meter and the volume resistivity meter for the intermediate transfer belt of the present invention.
Figure 6:
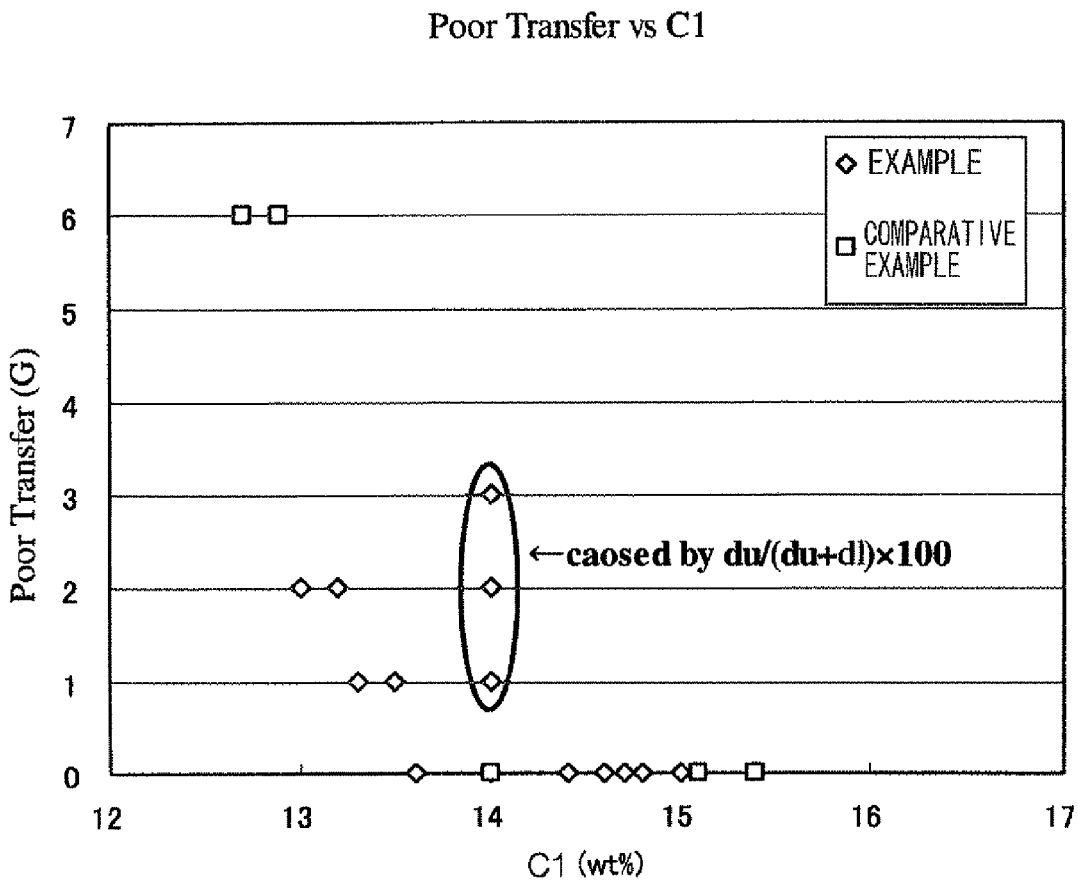
FIG. 6 is a chart showing results of Examples in term of poor transfer versus the content of polyaniline.
Figure 7:
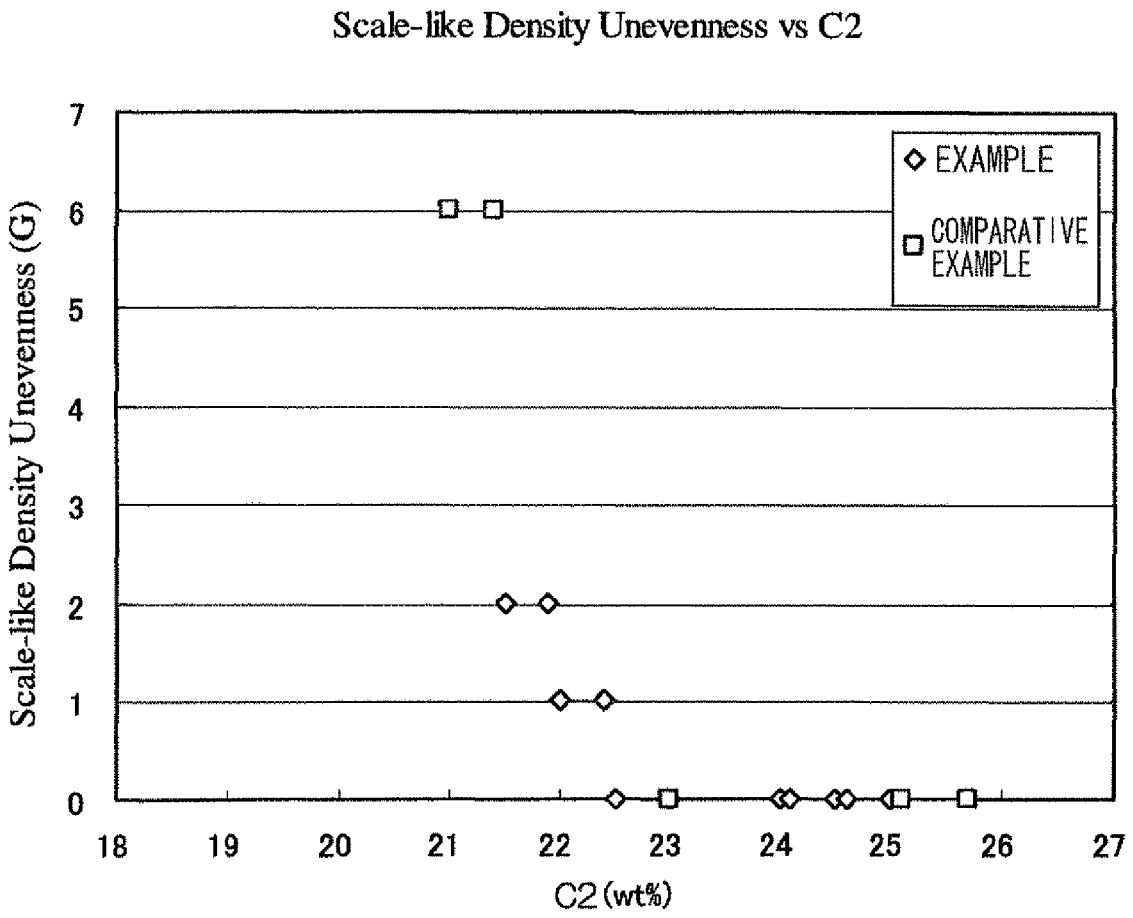
FIG. 7 is a chart showing results of Examples in term of scale-like density unevenness versus the content of carbon black.
Figure 8:
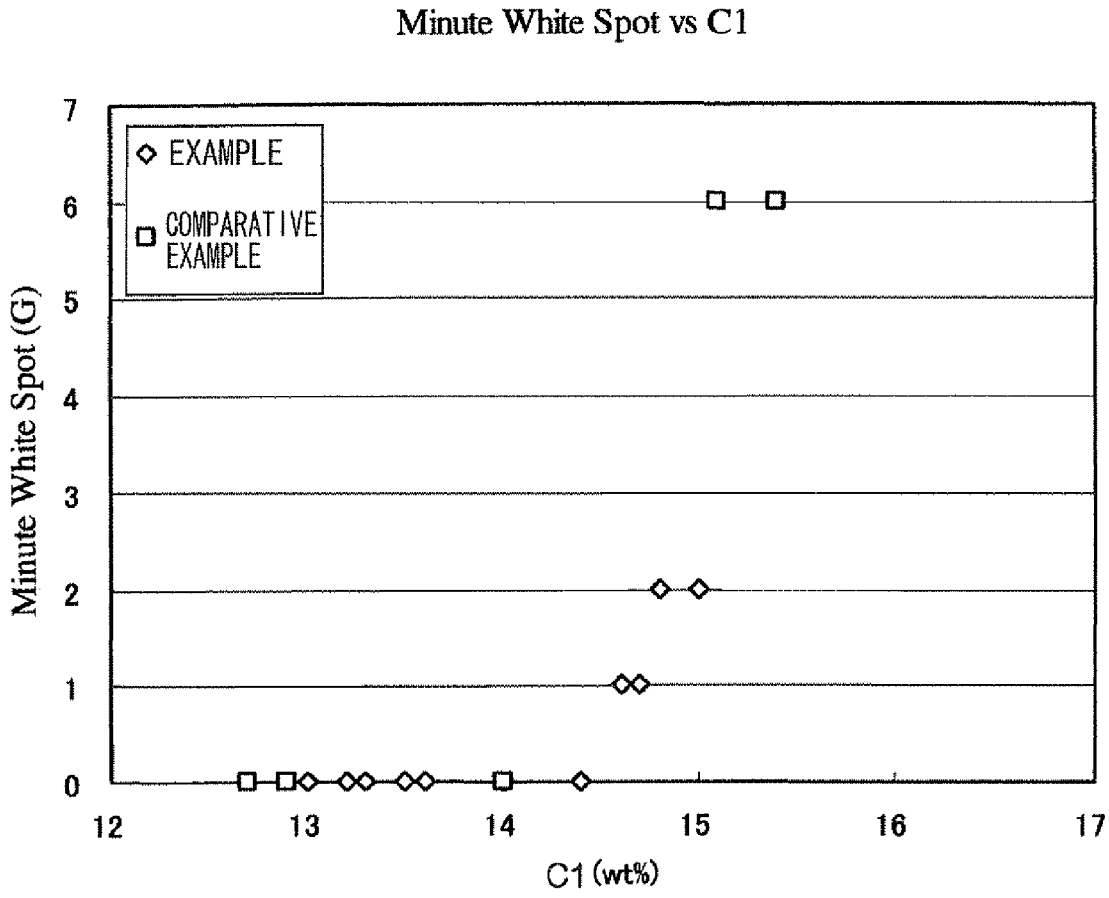
FIG. 8 is a chart showing results of Examples in term of minute white spots versus the content of polyaniline.
Figure 9:
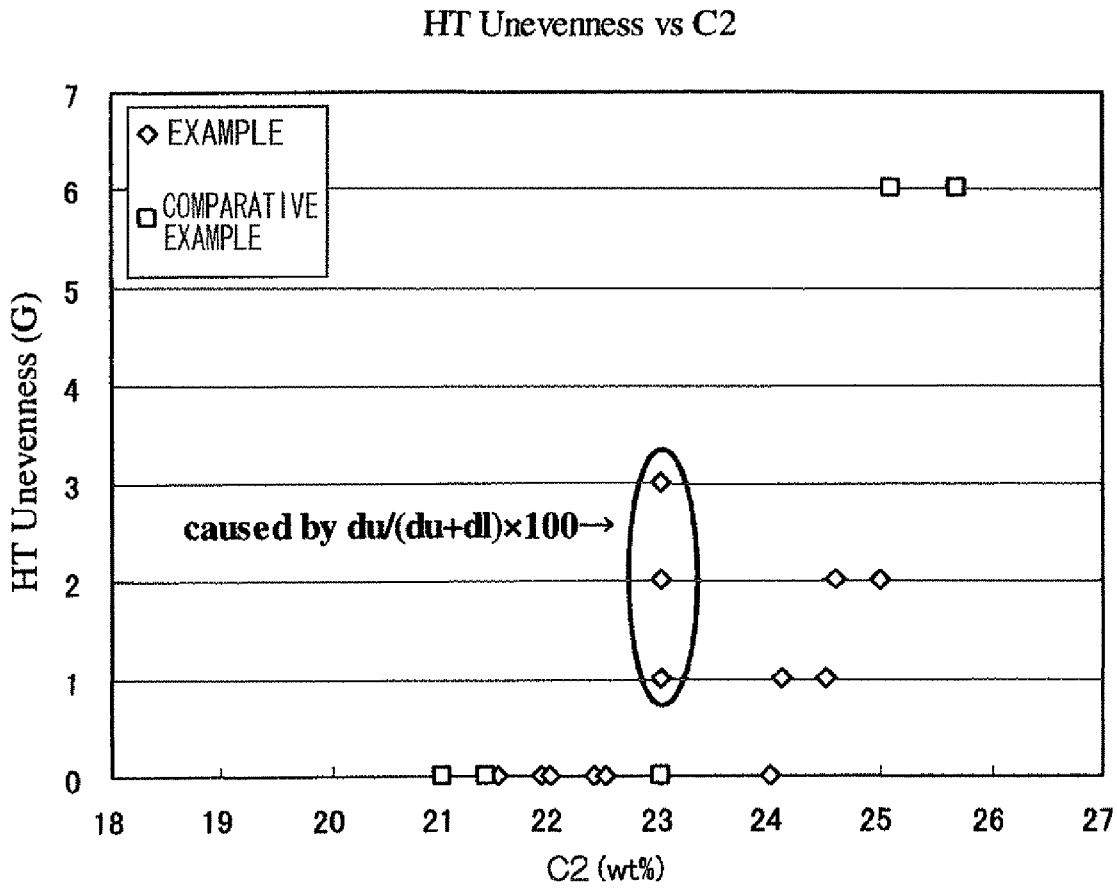
FIG. 9 is a chart showing results of Examples in term of HT unevenness versus the content of carbon black.

FIG. 5 is a top view schematic diagram of an electrode for use in the surface resistivity meter. A guard electrode 22 is concentrically located around the surface electrode 21 as the center. Here, d1 to d3 represent the diameter of the surface electrode 21, the diameter of an inner circle of the guard electrode 22, and the diameter of an outer circle of the guard electrode 22, respectively. These values can be suitably determined according to the dimension and shape of the measurement sample. For the measurement of the surface resistivity in this example, a UK probe (manufactured by Mitsubishi Chemical Corp.) is used and d1 to d3 are set to the following values:

d1=16 mm d2=30 mm d3=40 mm

The surface resistivity ρs is calculated according to equation (4):

$$\rho s=[\pi(d2+d1)/(d2-d1)]\times(V/I) \quad (4),$$

wherein V represents a voltage value (V) to be applied to the surface electrode 21 and I represents a current value (A) detected by the microammeter 26. In the measurement of the surface resistivity in this example, the voltage value to be applied to the surface electrode 21 is set to 500 V. The current value I is a value 10 seconds after the application of the voltage V. The measurement of the surface resistivity is performed under an environment of a temperature of 20° C. and a relative humidity of 40%.

(Measurement of Volume Resistivity ρs)

Figure 4:
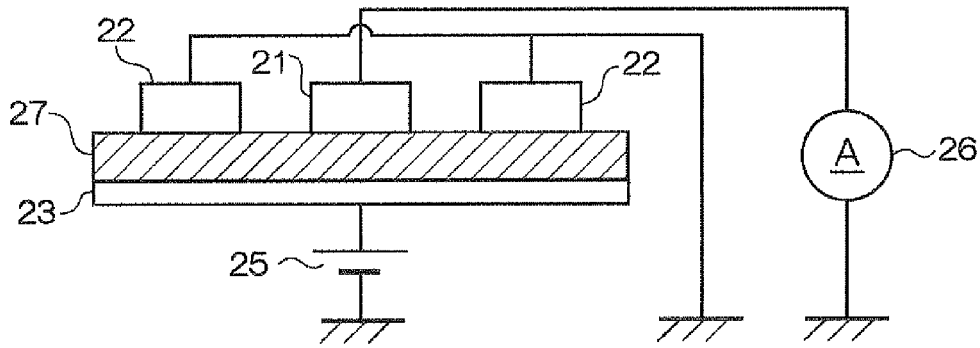
FIG. 4 is a cross-sectional schematic diagram of a volume resistivity meter for the intermediate transfer belt of the present invention.

FIG. 4 is a cross-sectional schematic diagram of a volume resistivity meter. A measurement sample 27 is located on a rear electrode 23 connected to GND via a direct current power source 25. A surface electrode 21 and a guard electrode 22 are located on the measurement sample 27, and the measurement sample 27 is sandwiched by the rear electrode 23 and the surface electrode 21 and the guard electrode 22 to form a sandwich structure. The guard electrode 22 is connected to GND A direct current voltage is applied by the direct current power source 25 connected to the rear electrode 23, and the amount of flowing current is measured by a microammeter 26 connected to the surface electrode 21 to calculate the volume resistivity.

FIG. 5 is a top view schematic diagram of an electrode for use in the volume resistivity meter. The guard electrode 22 is concentrically located around the surface electrode 21 as the center. Here, d1 to d3 represent the diameter of the surface electrode 21, the diameter of the inner circle of the guard electrode 22, and the diameter of the outer circle of the guard electrode 22, respectively. These values can be suitably determined according to the dimension and shape of the measurement sample. For the measurement of the volume resistivity in this example a UR probe (manufactured by Mitsubishi Chemical Corp.) is used and d1 to d3 are set to the following values:

d1=16 mm d2=30 mm d3=40 mm

The volume resistivity ρv is calculated according to equation (5):

$$\rho v=[(\pi\times d1^2)/4]\times(V/I)\times(1/t) \quad (5),$$

wherein V represents a voltage value (V) to be applied to the surface electrode 21, I represents a current value (A) detected by the microammeter 26, and t represents a film thickness (cm) of the measurement sample. In the measurement of the volume resistivity in this example, the voltage value to be applied to the surface electrode 21 is set to 500 V. The current value I is set to a value 10 seconds after the application of the voltage V. For the measurement of the film thickness t of the measurement sample, any known method, such as a method using a micrometer or an eddy-current coating thickness gauge, can be preferably used. In this example, the film thickness is measured by an eddy-current coating thickness gauge ISOSCOPE MP30 (manufactured by Fischer). The measurement of the volume resistivity is performed under an environment of a temperature of 20° C. and a relative humidity of 40%.

—Evaluation—

The intermediate transfer belt is mounted in an image evaluation apparatus obtained by remodeling a full color complex machine (DocuColor 8000 Digital Press: manufactured by Fuji Xerox) having the basic structure shown in FIG. 1 (in which the secondary transfer roll is separated from a power source installed in the image evaluation apparatus body, and connected to an external power source (MODEL 610D, manufactured by TRek), so that voltage can be directly applied to the secondary transfer roll from the exterior. A transfer voltage to be applied to the secondary transfer roll at the ime of printing is set to 4.0 kV. Minute white spots and poor transfer are graded with a cyan solid (density: 100%) image, scale-like density unevenness is graded with a cyan half-tone (density: 70%), and HT unevenness is graded with a cyan half-tone (density: 30%). Evaluation criteria are as follows. Results are shown in Tables 1 and 2.

<Minute White Spot>

G0: No generation of minute white spots is observed.

G1: Generation of minute white spots is slightly observed (within an acceptable level).

G2: Generation of minute white spots is observed (within an acceptable level).

G3: Generation of minute white spots can be easily confirmed (within an acceptable level).

G4: Level in which generation of minute white spots can be confirmed and is unacceptable.

G5: Generation of minute white spots becomes remarkable and considerably exceeds an acceptable level.

G6: The number of generated minute white spots and the dimension thereof become large and far exceed an acceptable level.

<Scale-Like Density Unevenness>

G0: No occurrence of scale-like density unevenness is observed

G1: Occurrence of scale-like density unevenness is slightly observed (within an acceptable level).

G2: Occurrence of scale-like density unevenness is observed (within an acceptable level).

G3: Occurrence of scale-like density unevenness can be easily confirmed (within an acceptable level).

G4: Level in which occurrence of scale-like density unevenness can be confirmed and is unacceptable.

G5: Occurrence of scale-like density unevenness becomes remarkable and considerably exceeds an acceptable level.

G6: Level in which a clear scale shape can be obtained.

<Poor Transfer>

G0: No reduction in density is observed.

G1: Reduction in density is slightly observed (within an acceptable level).

G2: Reduction in density is observed (within an acceptable level).

G3: Reduction in density can be easily confirmed (within an acceptable level).

G4: Level in which reduction in density can be confirmed and is unacceptable

G5: Reduction in density becomes remarkable and considerably exceeds an acceptable level.

G6: A dot shape cannot be confirmed due to reduction in density.

<HT Unevenness>

G0: No occurrence of HT unevenness is observed.

G1: Occurrence of HT unevenness is slightly observed (within an acceptable level).

G2: Occurrence of HT unevenness is observed (within an acceptable level).

G3: Occurrence of HT unevenness can be easily confirmed (within an acceptable level).

G4: Level in which occurrence of HT unevenness can be confirmed and is unacceptable.

G5: Occurrence of HT unevenness becomes remarkable and considerably exceeds an acceptable level.

G6: The number of portions having HT unevenness and the dimension thereof become large and far exceed an acceptable level.

TABLE 1

| * | Inter-mediate | Film thickness (μm) | | | | du/(du + | Amount of conductive agent (part by weight) | | | Surface resistivity | Volume | Image quality | | | |
|---|---|---|---|---|---|---|---|---|---|---|---|---|---|---|---|
| | | | | | | | | | | | | Cyan 100% | | Cyan 70% Scale-like | Cyan 30% |
| Ex. No. | transfer belt | du | dl | du + dl | Other Layer | dl) (%) | C1 | C2 | Other Layer | (Log Ω/□) | resistivity (Log Ω · cm) | Poor transfer | Minute white spot | density unevenness | HT unevenness |
| Ex. 1 | 1 | 67 | 33 | 100 | — | 67 | 13.0 | 23.0 | — | 10.07 | 11.02 | 2 | 0 | 0 | 0 |
| Ex. 2 | 2 | 67 | 33 | 100 | — | 67 | 13.2 | 23.0 | — | 10.05 | 11.00 | 2 | 0 | 0 | 0 |
| Ex. 3 | 3 | 67 | 33 | 100 | — | 67 | 13.3 | 23.0 | — | 10.01 | 11.10 | 1 | 0 | 0 | 0 |
| Ex. 4 | 4 | 67 | 33 | 100 | — | 67 | 13.5 | 23.0 | — | 9.98 | 10.96 | 1 | 0 | 0 | 0 |
| Ex. 5 | 5 | 67 | 33 | 100 | — | 67 | 13.6 | 23.0 | — | 9.96 | 10.94 | 0 | 0 | 0 | 0 |
| Ex. 6 | 6 | 67 | 33 | 100 | — | 67 | 14.0 | 23.0 | — | 9.97 | 10.89 | 0 | 0 | 0 | 0 |
| Ex. 7 | 7 | 67 | 33 | 100 | — | 67 | 14.4 | 23.0 | — | 9.95 | 10.85 | 0 | 0 | 0 | 0 |
| Ex. 8 | 8 | 67 | 33 | 100 | — | 67 | 14.6 | 23.0 | — | 9.92 | 10.85 | 0 | 1 | 0 | 0 |
| Ex. 9 | 9 | 67 | 33 | 100 | — | 67 | 14.7 | 23.0 | — | 9.87 | 10.83 | 0 | 1 | 0 | 0 |
| Ex. 10 | 10 | 67 | 33 | 100 | — | 67 | 14.8 | 23.0 | — | 9.90 | 10.84 | 0 | 2 | 0 | 0 |
| Ex. 11 | 11 | 67 | 33 | 100 | — | 67 | 15.0 | 23.0 | — | 9.87 | 10.79 | 0 | 2 | 0 | 0 |
| Ex. 12 | 12 | 67 | 33 | 100 | — | 67 | 14.0 | 21.5 | — | 10.02 | 10.88 | 0 | 0 | 2 | 0 |
| Ex. 13 | 13 | 67 | 33 | 100 | — | 67 | 14.0 | 21.9 | — | 10.00 | 10.79 | 0 | 0 | 2 | 0 |
| Ex. 14 | 14 | 67 | 33 | 100 | — | 67 | 14.0 | 22.0 | — | 9.98 | 10.75 | 0 | 0 | 1 | 0 |
| Ex. 15 | 15 | 67 | 33 | 100 | — | 67 | 14.0 | 22.4 | — | 9.96 | 10.69 | 0 | 0 | 1 | 0 |
| Ex. 16 | 16 | 67 | 33 | 100 | — | 67 | 14.0 | 22.5 | — | 9.97 | 10.66 | 0 | 0 | 0 | 0 |
| Ex. 17 | 17 | 67 | 33 | 100 | — | 67 | 14.0 | 23.0 | — | 9.95 | 10.58 | 0 | 0 | 0 | 0 |
| Ex. 18 | 18 | 67 | 33 | 100 | — | 67 | 14.0 | 24.0 | — | 9.86 | 10.40 | 0 | 0 | 0 | 0 |
| Ex. 19 | 19 | 67 | 33 | 100 | — | 67 | 14.0 | 24.1 | — | 9.85 | 10.39 | 0 | 0 | 0 | 1 |
| Ex. 20 | 20 | 67 | 33 | 100 | — | 67 | 14.0 | 24.5 | — | 9.83 | 10.24 | 0 | 0 | 0 | 1 |
| Ex. 21 | 21 | 67 | 33 | 100 | — | 67 | 14.0 | 24.6 | — | 9.82 | 10.20 | 0 | 0 | 0 | 2 |
| Ex. 22 | 22 | 67 | 33 | 100 | — | 67 | 14.0 | 25.0 | — | 9.80 | 10.11 | 0 | 0 | 0 | 2 |
| Ex. 23 | 23 | 50 | 50 | 100 | — | 50 | 14.0 | 23.0 | — | 9.89 | 10.00 | 0 | 0 | 0 | 2 |
| Ex. 24 | 24 | 55 | 45 | 100 | — | 55 | 14.0 | 23.0 | — | 9.88 | 10.21 | 0 | 0 | 0 | 1 |
| Ex. 25 | 25 | 61 | 39 | 100 | — | 61 | 14.0 | 23.0 | — | 9.78 | 10.23 | 0 | 0 | 0 | 0 |

TABLE 2

| ** | Inter-mediate | Film thickness (μm) | | | | du/(du + | Amount of conductive agent (part by weight) | | | Surface | Volume resistivity | Image quality | | | |
|---|---|---|---|---|---|---|---|---|---|---|---|---|---|---|---|
| | | | | | | | | | | | | Cyan 100% | | Cyan 70% Scale-like | Cyan 30% |
| | transfer belt | du | dl | du + dl | Other Layer | dl) (%) | C1 | C2 | Other Layer | resistivity (Log Ω/□) | (Log Ω · cm) | Poor transfer | Minute white spot | density unevenness | HT unevenness |
| Ex. 26 | 26 | 74 | 26 | 100 | — | 74 | 14.0 | 23.0 | — | 9.72 | 10.31 | 0 | 0 | 0 | 0 |
| Ex. 27 | 27 | 76 | 24 | 100 | — | 76 | 14.0 | 23.0 | — | 9.69 | 10.39 | 1 | 0 | 0 | 0 |
| Ex. 28 | 28 | 80 | 20 | 100 | — | 80 | 14.0 | 23.0 | — | 9.70 | 10.42 | 2 | 0 | 0 | 0 |
| Ex. 29 | 29 | 62 | 33 | 95 | 5 Outer surface layer | 65 | 14.0 | 23.0 | 22.0 CB | 9.930 | 10.80 | 0 | 0 | 0 | 0 |
| Ex. 30 | 30 | 62 | 33 | 95 | 5 Inner surface layer | 65 | 14.4 | 23.0 | 15.4 PAn | 9.910 | 10.77 | 0 | 0 | 0 | 0 |
| Com. Ex. 1 | 31 | 67 | 33 | 100 | — | 67 | 12.9 | 23.0 | — | 10.60 | 11.09 | 6 | 0 | 0 | 0 |
| Com. Ex. 2 | 32 | 67 | 33 | 100 | — | 67 | 12.7 | 23.0 | — | 10.81 | 11.14 | 6 | 0 | 0 | 0 |
| Com. Ex. 3 | 33 | 67 | 33 | 100 | — | 67 | 15.1 | 23.0 | — | 9.87 | 10.81 | 0 | 6 | 0 | 0 |
| Com. Ex. 4 | 34 | 67 | 33 | 100 | — | 67 | 15.4 | 23.0 | — | 9.79 | 10.79 | 0 | 6 | 0 | 0 |

TABLE 2-continued

| ** | Intermediate transfer belt | Film thickness (μm) du | dl | du + dl | Other Layer | du/(du + dl) (%) | Amount of conductive agent (part by weight) C1 | C2 | Other Layer | Surface resistivity (Log Ω/□) | Volume resistivity (Log Ω · cm) | Image quality Cyan 100% Poor transfer | Minute white spot | Cyan 70% Scale-like density unevenness | Cyan 30% HT unevenness |
|---|---|---|---|---|---|---|---|---|---|---|---|---|---|---|---|
| Com. Ex. 5 | 35 | 67 | 33 | 100 | — | 67 | 14.0 | 21.4 | — | 10.06 | 10.82 | 0 | 0 | 6 | 0 |
| Com. Ex. 6 | 36 | 67 | 33 | 100 | — | 67 | 14.0 | 21.0 | — | 10.11 | 10.91 | 0 | 0 | 6 | 0 |
| Com. Ex. 7 | 37 | 67 | 33 | 100 | — | 67 | 14.0 | 25.1 | — | 10.08 | 10.10 | 0 | 0 | 0 | 6 |
| Com. Ex. 8 | 38 | 67 | 33 | 100 | — | 67 | 14.0 | 25.7 | — | 9.89 | 10.02 | 0 | 0 | 0 | 6 |

In Table 1 and Table 2, * Ex. No. means Example No. In Table 2, Com. Ex. No. means Comparative Example No.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

All publications, patent applications, and technical standards mentioned in this specification are herein incorporated by reference to the same extent as if such individual publication, patent application, or technical standard was specifically and individually indicated to be incorporated by reference. It is intended that the scope of the invention be defined by the following claims and their equivalents.

What is claimed is:

1. A circular body, which is used for an image forming apparatus employing an electrophotographic system, the circular body comprising:

at least an inner layer containing resin and an outer layer that is laminated on an outer circumferential surface side of the inner layer and contains resin; and as a conductive agent, polyaniline in the outer layer and carbon black in the inner layer, and satisfying the following relational expressions (1) and (2):

$$13.0 \leqq C1 \leqq 15.0 \quad (1)$$

$$21.5 \leqq C2 \leqq 25.0 \quad (2),$$

wherein C1 represents the content (parts by weight) of the polyaniline based on 100 parts by weight of the resin forming the outer layer, and C2 represents the content (parts by weight) of the carbon black based on 100 parts by weight of the resin forming the inner layer.

2. The circular body of claim 1, wherein C1 satisfies the following relational expression:

$$13.3 \leqq C1 \leqq 14.7.$$

3. The circular body of claim 1, wherein C1 satisfies the following relational expression:

$$13.6 \leqq C1 \leqq 14.4.$$

4. The circular body of claim 1, wherein C2 satisfies the following relational expression:

$$22.0 \leqq C2 \leqq 24.5.$$

5. The circular body of claim 1, wherein C2 satisfies the following relational expression:

$$22.5 \leqq C2 \leqq 24.0.$$

6. The circular body of claim 1, satisfying the following relational expression (3):

$$50 \leqq du/(du+dl) \times 100 \leqq 80 \quad (3),$$

wherein du represents a film thickness (μm) of the outer layer, and dl represents a film thickness (μm) of the inner layer.

7. The circular body of claim 6, wherein du and dl satisfy the following relational expression:

$$55 \leqq du/(du+dl) \times 100 \leqq 76.$$

8. The circular body of claim 6, wherein du and dl satisfy the following relational expression:

$$61 \leqq du/(du+dl) \times 100 \leqq 74.$$

9. The circular body of claim 1, wherein a sum of a thickness of the inner layer and a thickness of the outer layer is from 50 μm to 130 μm.

10. The circular body of claim 1, wherein the resin is a thermoplastic resin selected from the group consisting of polycarbonate resin, polyvinylidene fluoride resin, polyalkylene phthalate resin, a blended material of polycarbonate/polyalkylene phthalate, and an ethylenetetrafluoroethylene copolymer, or a thermosetting resin selected from the group consisting of polyimide, polyamidoimide, and a copolymer of polyimide and polyamide.

11. A circular body tensioning device comprising:

the circular body of claim 1; and two or more rotating members for rotatably passing therearound the circular body from an inner surface side in a state in which tension is applied.

12. An image forming apparatus comprising:

an image support;

a charging device for charging the image support;

an exposure device for forming an electrostatic latent image on the image support charged by the charging device, a developing device for developing the electrostatic latent image on the image support to form a toner image;

a primary transfer unit for transferring the toner image to an intermediate transfer belt;

a secondary transfer unit for transferring the toner image transferred to the intermediate transfer belt to a transfer-receiving medium; and a fixing device for fixing the toner image on the transfer-receiving medium, the intermediate transfer belt being the circular body of claim 1.

13. The image forming apparatus according to claim 12, wherein the toner image is a full color multiple toner image.

14. The image forming apparatus according to claim 12, wherein, in the primary transfer unit, the surface of a primary transfer member touching an inner surface of the intermediate transfer belt is formed of metal.

15. The image forming apparatus according to claim 12, wherein, in the secondary transfer unit, the surface of a secondary transfer member touching the inner surface of the intermediate transfer belt is formed of metal.

16. The image forming apparatus according to claim 14, wherein the metal is metal having a surface plated with nickel, copper, or chromium.

17. The image forming apparatus according to claim 15, wherein the metal is metal having a surface plated with nickel, copper, or chromium.

* * * * *